US007238929B2

(12) United States Patent
Baier

(10) Patent No.: US 7,238,929 B2
(45) Date of Patent: Jul. 3, 2007

(54) OPERATING DEVICE AND OPERATING METHOD FOR AN ELECTRIC DOMESTIC APPLIANCE

(75) Inventor: Martin Baier, Ettlingen (DE)

(73) Assignee: E.G.O Elektro-Geraetebau GmbH (DE)

( * ) Notice: Subject to any disclaimer, the term of this patent is extended or adjusted under 35 U.S.C. 154(b) by 185 days.

(21) Appl. No.: 10/944,021

(22) Filed: Sep. 17, 2004

(65) Prior Publication Data

US 2005/0061958 A1 Mar. 24, 2005

(30) Foreign Application Priority Data

Sep. 18, 2003 (DE) ..... 103 45 352

(51) Int. Cl.
*G09G 5/00* (2006.01)

(52) U.S. Cl. ..... 250/221; 345/175

(58) Field of Classification Search ..... 250/221, 250/222.1, 342; 345/173, 175, 157, 166
See application file for complete search history.

(56) References Cited

U.S. PATENT DOCUMENTS 6,603,462 B2 8/2003 Matusis
2001/0003451 A1* 6/2001 Armstrong ..... 345/173
2002/0126098 A1* 9/2002 Sato ..... 345/172
2003/0137494 A1* 7/2003 Tulbert ..... 345/173
2004/0046741 A1* 3/2004 Low et al. ..... 345/166
2004/0160335 A1 8/2004 Reitmeier

FOREIGN PATENT DOCUMENTS

| | | |
|---|---|---|
| EP | 0446642 | 9/1991 |
| EP | 0551240 | 7/1993 |
| EP | 1303168 | 4/2003 |

* cited by examiner

*Primary Examiner*—Kevin Pyo
(74) *Attorney, Agent, or Firm*—Akerman Senterfitt

(57) ABSTRACT

In an operating device for a cooking system with a hob and an operating surface, at least one operating element with a contact detection function is positioned under the operating surface. The at least one operating element is implemented as a motion or movement sensor with a camera, which detects a movement or a contact point on the operating surface and determines a position and/or a position change of the contact point on the operating surface. In an operating method for activating an operating function an evaluation unit evaluates the position or the position change of the contact point.

17 Claims, 1 Drawing Sheet

OPERATING DEVICE AND OPERATING METHOD FOR AN ELECTRIC DOMESTIC APPLIANCE

CROSS-REFERENCE TO RELATED APPLICATIONS

The following disclosure is based on and claims the benefit of German Application No. 103 45 352.0, filed Sep. 18, 2003, the entirety of which is incorporated herein by reference.

BACKGROUND OF THE INVENTION

1. Field of the Invention

The present invention is related to the field of electrical devices, and, more particular to electrical appliances and methods for their operation.

2. Description of the Related Art

The operation of electrical appliances such as those used in cooking systems and for other types domestic and office frequently involve the use of capacitive or optically operating switching elements, which are preferably positioned under an operating area like a glass ceramic hob that is provided with an operating surface. These switching elements detect whether a finger of a user is or is not located on the operating surface. Sliding switches and similar switching elements typically can only be implemented with such operating elements by providing several such operating elements positioned successively with one another. This can impose a considerable space requirement and involve considerable costs.

SUMMARY OF THE INVENTION

The present invention provides an operating device for an electrical appliance and an associated operating method which obviate the disadvantages of conventional operating and devices, and, in particular, permit more efficient operation of a domestic electrical appliance while also providing increased operating comfort.

The invention, more particularly, provides an operating device having at least one operating element, positioned below an operating surface of the device, and an evaluating unit for activating an operating function for an electrical applicance. Advantageous and preferred developments of the invention are given in the claims and are described in greater detail hereinafter. By express reference the wording of the claims is made into part of the content of the description.

The invention is based on the idea of providing below an operating surface an optical recording device, such as a camera or the like, which is below an operating surface and is part of a movement or motion sensor, that detects at least one movement or contact point on the operating surface. It determines a position and/or a position change of the movement or contact point on the operating surface. For activating an operating function, the position or position change of the contact point is evaluated. When used, for example, as part of a hob, if a finger is placed or moved to or on a specific point of the hob, this is detected and linked with a specific operating function.

Through the use of a camera it is possible to implement an operating element or a recording device, which can resolve the position and/or the position change of the operation, a finger or the like, in a number of stages, for example 10 to 50 steps. It is thus possible to establish operations or movements both in the x and y direction. It is sufficient for the optical recording device to have a limited resolution, for example in rastered steps, as stated hereinbefore. It can be a type of camera with line resolution.

If the operating surface is illuminated from below, illumination improves detection of the movement or the contact point to or on the operating surface. Illumination can be brought about in numerous different ways.

For the detection of random movements, such as rotary movements and/or linear movements, corresponding optical systems such as lenses and/or mirrors can be provided. This makes it possible to cover a larger surface area than would be possible from the recording device.

In an advantageous embodiment of the invention the operating surface is implemented as a line and/or as a multi-line area, in particular with several lines. Each operating surface can be provided with its own function, which can for example be made clear by printed-on symbols.

The optical recording device can scan the operating surface continuously or in fixed time intervals. Scanning with time intervals has the advantage that evaluation is simpler, because the volume of data is smaller.

The position and/or position change of the movement or the contact point on the operating surface can be established by an image comparison of images of the operating surface successively produced by the optical recording device. The optical recording device can be in the form of a camera or the like, which is advantageously implemented as a CCD chip. It can have its sensitivity maximum and can be operated in the infrared range. In a particularly simple variant of the invention, use can be made of a recording device, such is otherwise used in so-called optical computer mice, advantageously with minimum constructional changes. This can lead to a very cost efficient arrangement.

For detecting the boundary of the operating surface, illumination thereof is possible, for example in the IR range. This advantageously occurs from above. The cover of a contact point against illumination can additionally be used for operating purposes, which increases operating safety. This also applies to movements.

The operating method for a cooking system according to the invention, after detecting a movement or contact point on an operating area, determines a position and/or a movement of the contact point with a camera. Then the position and/or movement of the contact point is evaluated and an operating function is activated as a function of the evaluation result.

These and further features can be gathered from the claims, description and drawing, whereby the individual features, both singly and in the form of sub-combinations, can be implemented in an embodiment of the invention and in other fields and can represent advantageous, independently protectable constructions for which protection is claimed here. The subdivision of the application into individual sections and also the subheadings in no way restricts the general validity of the statements made thereunder.

BRIEF DESCRIPTION OF THE DRAWING

There is shown in the drawing, an embodiment presently preferred, it being understood, however, that the invention is not limited to the precise arrangements and instrumentalities shown.

DETAILED DESCRIPTION OF THE INVENTION

Figure 1:
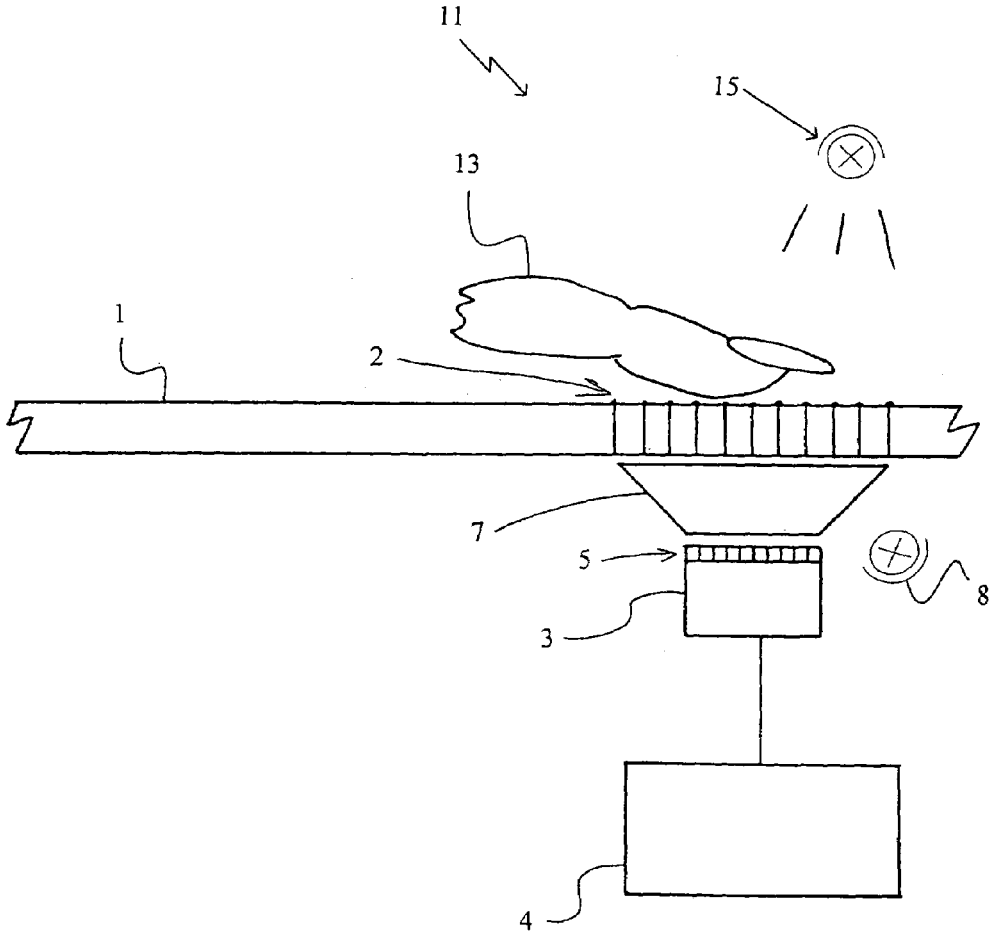
FIG. 1 provides a schematic diagram of an operating device for an electrical appliance according to one embodiment of the present invention.

As is apparent from FIG. 1, an operating device 11 located on a hob 1, according to one embodiment of the present invention, comprises an operating surface 2, a camera 3 as the optical recording device and an evaluating unit 4. A finger 13 is placed on a specific point on the operating surface 2. An optical lens 7 as the optical system is located between the camera 3 and operating surface 2. The lens 7 can enlarge the visual field of the camera 3, so that the operating surface admittedly has precisely the same number of individual surfaces as the camera from the resolution standpoint, but said individual surfaces are larger.

An illumination 8 from below the operating surface 2 is shown. It can be implemented in numerous different ways and is advantageously once again similar to the aforementioned optical computer mice. It can also be connected to the camera 3 or control 4, for example for illumination intensity control purposes.

The represented operating surface 2 is implemented as a line with several contact points, in the present case ten contact points, which are marked on the surface, as is apparent from the drawing. As required and depending on the desired resolution, the number of pixels per line can e.g. be 10 or 32, 64 or 128. When used in the form of a multi-line area, the operating surface can be approximately 5×5 $cm^2$ or 6×1 $cm^2$. There can also be several lines in the form of an area. In the represented embodiment the operating surface 2 can be illuminated by the lighting unit 15, which is optional and shown top right, for the detection of its boundaries and also any contact, illumination taking place from below.

The camera 3 with the line 5 symbolically represented on the top side detects a contact point on the operating surface 2, for example through finger 13, which is moved from above towards the operating surface 2 or placed on the contact point on the latter. The camera 3 produces approximately 150 images per second, which are evaluated by the evaluating unit 4 with respect to changes, for example by comparison of successively recorded images. To reduce processing costs, it can be advantageous to record far fewer images, for example 10 to 20 per second. The recording frequency can also depend on whether there is a change of state. It can then change from relatively long to short intervals.

If a change in the form of a contact process and therefore an operation is detected, then the evaluating unit 4 determines the position and/or position change of the contact point. With a specific contact point can be associated a specific function, particularly a switching function. This can for example be an ON or OFF switching function. If there is a movement, on the basis of the comparison of the images, it can be established in which direction the object or finger 3 has been moved and also how rapidly. As a function of the evaluation result, the evaluating unit 4 activates an operating function associated with the position and/or position change.

The camera 3 is implemented as a CCD camera, for example as a CCD chip with 17×17 lines. A magnification or enlargement of the recording field of the camera 3 is possible through the lens 7 or further optical systems such as mirrors or the like.

A faulty or incorrectly detected operating input can for example be indicated by the flickering of the operating surface and/or a corresponding signal.

Thus, in the case of an exemplified operating device for a cooking system with a hob and an operating surface, below the latter can be provided at least one operating element with a contact detection function. The at least one operating element is implemented as a movement sensor with a camera, which detects a movement or contact point on the operating surface and determines a position and/or a position change of the contact point on the operating surface. The position or position change of the contact point is evaluated by an evaluating unit during an operating process for activating an operating function.

I claim:

1. An operating device for an electrical appliance, said operating device comprising:

an operating surface having a plurality of distinct regions, each region uniquely corresponding to one of a plurality of different operating functions of said electrical appliance;

at least one operating element below said operating surface, wherein said at least one operating element has at least one movement sensor, and wherein said at least one movement sensor has an optical recording device for detecting a movement or a contact point of a finger at or on said operating surface and determining a position or a position change of said movement or said contact point at or on said operating surface;

a lens disposed between the operating surface and at least one optical recording device to enlarge a visual field of the optical recording device such that the operating surface and the optical recording device have an equal number of corresponding surface portions, each surface portion of the operating surface being magnified by the lens to a size larger than the corresponding surface portion of the optical recording device; and an evaluating unit for selectively actuating at least one of said plurality of distinct operating functions based upon said position or said position change of said contact point.

2. The operating device according to claim 1, wherein said electrical appliance is a cooking system.

3. The operating device according to claim 1, wherein said operating surface is illuminated from below.

4. The operating device according to claim 1 ,wherein, for detecting said movement or said contact point, an optical system having at least one mirror is positioned under said operating surface and is combined with said optical recording device.

5. The operating device according to claim 1, wherein said operating surface is implemented as a line.

6. The operating device according to claim 1, wherein said operating surface is implemented as a multi-line surface having individual partial surfaces or areas corresponding to the plurality of distinct regions.

7. The operating device according to claim 1, wherein said optical recording device has a surface-based resolution in rastered steps.

8. The operating device according to claim 7, wherein said optical recording device has a surface-based resolution in at least one line, wherein said line has several areas corresponding to the plurality of distinct regions.

9. The operating device according to claim 8, wherein said operating surface is subdivided and said stepped rastering of said surface-based resolution of said optical recording device corresponds to said subdivision.

10. The operating device according to claim 1, wherein said optical recording device scans said operating surface with time intervals dependent on said movement.

11. The operating device according to claim 1, wherein said optical recording device successively produces images of said operating surface, and said images are compared for establishing said position or said position change of said contact point on said operating surface.

12. The operating device according to claim 1, wherein said optical recording device is a camera.

13. The operating device according to claim 12, wherein said optical recording device has a CCD chip.

14. A method of operating an operating device for an electrical appliance, said operating device having an operating surface and an optical recording device for detecting a movement or a contact point on said operating surface, wherein said method comprises:

positioning a lens between the operating surface and at least one optical recording device to enlarge a visual field of the optical recording device such that the operating surface and the optical recording device have an equal number of corresponding surface portions, each surface portion of the operating surface being magnified by the lens to a size larger than the corresponding surface portion of the optical recording device;

detecting with said optical recording device a movement along or a contact point at one of plurality of distinct regions of said operating surface, each distinct region uniquely corresponding to one of a plurality of different operating functions of said operating device;

evaluating the movement or contact point detected; and selectively actuating at least one of said plurality of different operating functions based upon said evaluation.

15. The operating device according to claim 2, wherein said operating surface is illuminated from below.

16. The operating device according to claim 1, wherein each of said different operating functions is indicated by a corresponding printed-on symbol on said operating surface for each operating function.

17. The method according to claim 14, further comprising indicating each of said different operating functions by a printed-on symbol on said operating surface, each printed symbol uniquely corresponding to a different operating function.

* * * * *